United States Patent [19]

Nantin

[11] Patent Number: 4,782,646

[45] Date of Patent: Nov. 8, 1988

[54] METHOD AND AN ARRANGEMENT FOR THE FINISHING OF AN OPENING ARRANGEMENT ON A PACKING CONTAINER

[75] Inventor: Hans Nantin, Trelleborg, Sweden

[73] Assignee: AB Tetra Pak, Lund, Sweden

[21] Appl. No.: 38,988

[22] Filed: Apr. 16, 1987

[30] Foreign Application Priority Data

Apr. 17, 1986 [SE] Sweden ..... 8601761

[51] Int. Cl.[4] ..... B65B 61/18

[52] U.S. Cl. ..... 53/410; 53/412; 493/212; 493/923; 493/962; 493/963

[58] Field of Search ..... 53/410, 412, 133; 493/101, 213, 923, 962, 963; 156/286, 287; 229/123.2, 123.3

[56] References Cited

U.S. PATENT DOCUMENTS

| | | | |
|---|---|---|---|
| 2,131,625 | 9/1938 | Joplin | 53/133 |
| 2,365,159 | 12/1944 | Walton | 53/412 X |
| 2,496,336 | 2/1950 | Cupo | 53/410 |
| 3,815,484 | 6/1974 | Jones | 493/963 X |
| 3,883,034 | 5/1975 | Rausing . | |
| 3,900,155 | 8/1975 | Rausing et al. . | |
| 4,223,789 | 9/1980 | Reil | 229/123.3 |
| 4,397,401 | 8/1983 | Ueno | 53/412 X |
| 4,585,498 | 4/1986 | Lagerstedt et al. . | |
| 4,646,507 | 3/1987 | Ohlsson | 53/133 X |

*Primary Examiner*—John Sipos

*Attorney, Agent, or Firm*—Burns, Doane, Swecker & Mathis

[57] ABSTRACT

In the manufacture of aseptic packing containers from weblike laminate material, the material usually is brought into contact with a liquid sterilizing agent which, after a certain treatment period, is removed again. In order to avoid any accumulation of residues of sterilizing agent behind lugs, opening strips or the like a method and an arrangement for finishing an opening arrangement (2) on a packing container (1) are proposed, according to which an external gripping element (3) is placed over the opening region (4) only after the packing container (1) has been filled with the desired contents and has been closed. This is achieved with the help of a sealing unit (9) with a vacuum device (10) and a gas-permeable striplike gripping element (3).

4 Claims, 2 Drawing Sheets

METHOD AND AN ARRANGEMENT FOR THE FINISHING OF AN OPENING ARRANGEMENT ON A PACKING CONTAINER

FIELD OF THE INVENTION

The present invention relates to a method for the finishing of an opening arrangement on a filled and closed packing container which is manufactured from a flexible packing material.

The invention also relates to an arrangement for the realization of the method, and an opening arrangement produced with the help of the method and the arrangement in accordance with the invention.

BACKGROUND OF THE INVENTION

In the manufacture of packing containers from web-like, flexible packing laminate the laminate is given first a form, e.g. a tubular form, suitable for receiving the contents, whereupon the contents are introduced and individual packing containers are shaped and sealed through transverse sealing off and formprocessing of the packing laminate tube. This procedure and a machine for the realization of the same are described in greater detail in Swedish patent application No. 8202302-9, to which reference is made. The abovementioned type of packing container, which is generally used for milk, juice or other liquid foodstuffs, is provided with, among other things, an opening arrangement in the form of a tear-off cover strip (so-called pull-tab) placed over a prepared pouring opening. The opening arrangement here is formed while the packing laminate is in form of a web, and the opening arrangement including the cover strip, therefore, have to accompany the packing laminate through the packing machine during the conversion of the packing laminate to individual, filled packing containers. This can be realized normally without any major inconvenience. In the type of packing machine which manufactures aseptic packing containers intended to be filled with sterile contents the packing material web passes a bath or a chamber with sterilizing agent (usually hydrogen peroxide) which after it has sterilized the web is removed again with the help of mangle rollers or hot air. When the packing material web is provided with a cover strip placed on the outside thereof there is a risk that sterilizing agent which has penetrated in between the cover strip and the outside of the packing laminate is not completely removed, which is an obvious disadvantage.

An opening arrangement of the abovementioned type usually consists of a pouring opening provided in the packing laminate. The pouring opening is punched out during the manufacture of the laminate in its carrier layer, which customarily consists of paper. Thereafter, the carrier layer is coated with the required layers of thermoplastic material and aluminium foil and possibly further layers which will thus cover the punched-out hole in a water-tight manner. After the packing laminate thus has been completed the cover strip is applied to the outside of the laminate, whereupon the part of the cover strip located over the hole is joined by hotsealing to the thermoplastic layer which covers the pouring opening, so that it follows along and uncovers the pouring opening when the cover strip is removed from the finished packing container by the consumer.

OBJECTS AND SUMMARY OF THE INVENTION

It is an object, therefore, to provide a method for manufacturing an opening arrangement of the abovementioned type, this method being specially adapted for use in the manufacture of packing containers in aseptic packing machines which sterilize the packing material web by means of a chemical sterilizing agent.

It is a further object to provide a method for finishing an opening arrangement of the abovementioned type, this method making it possible to avoid any parts of the opening arrangement being applied to the material web which are liable to pass the sterilizing equipment of the packing machine.

These and other objects have been achieved in accordance with the invention in that a method of the type mentioned in the introduction is given the characteristic that the packing container after filling and closing is provided wtih a gripping element which is placed on the outside of the packing container and is joined to an openable area.

The method in accordance with the invention implies that the gripping element or the cover strip is applied to the packing material only after the latter has been converted to individual, closed packing containers. Consequently, the cover strip or the gripping element no longer have to pass through the sterilizing equipment of the packing machine, as a result of which the risk of any sterilizing agent remaining under the cover strip is wholly eliminated. The method also makes it possible to apply the cover strip or the gripping element over the openable area without any holding-up tool other than through the contents present in the packing container, which up to now has not been possible.

It is a further object to produce an opening arrangement which is of such a design that the gripping element or the cover strip can be applied over the openable area after the packing container has been finished, filled and closed.

This object has been achieved in accordance with the invention in that an opening arrangement for packing containers, whose wall material has a weakened, openable area, is given the characteristic that it comprises a gripping element applied over the openable area in the form of a strip which within an area joined to the outside of the openable area has a gas-permeable portion.

By providing the striplike gripping element with a gaspermeable portion, which usually can be in the form of an opening in the strip, it becomes possible to force together the cover strip and the thermoplastic layer covering the pouring opening of the packing material with such a force that a satisfactory sealing can be achieved without any holding-up tool other than through the contents present inside the packing container.

It is a further object of the present invention to provide an arrangement for the finishing of an opening arrangement on a filled and closed packing container manufactured from flexible material.

It is a further object, moreover, to give the arrangement a design which enables it to apply a striplike gripping element and seal it to the thermoplastic layer without utilizing any mechanical holding-up tool proper inside the packing container.

These and other objects have been achieved in accordance with the invention in that the arrangement is given the characteristic that it has a sealing unit for the gripping element, movable in relation to the packing container, this unit comprising a vacuum element and a sealing device.

By using a vacuum element for evacuating the air via the gaspermeable portion of the striplike gripping element between the gripping element and the thermoplastic layer of the packing laminate these can be forced towards each other with the help of the pressure difference with such a force that an effective hotsealing is achieved.

BRIEF DESCRIPTION OF THE DRAWING

A preferred embodiment of the method, the opening arrangement and the application arrangement in accordance with the invention will now be described in greater detail with special reference to the schematic drawing attached wherein only the details indispensable for an understanding of the invention are shown, and wherein.

DETAILED DESCRIPTION OF A PREFERRED EMBODIMENT

Figure 1:
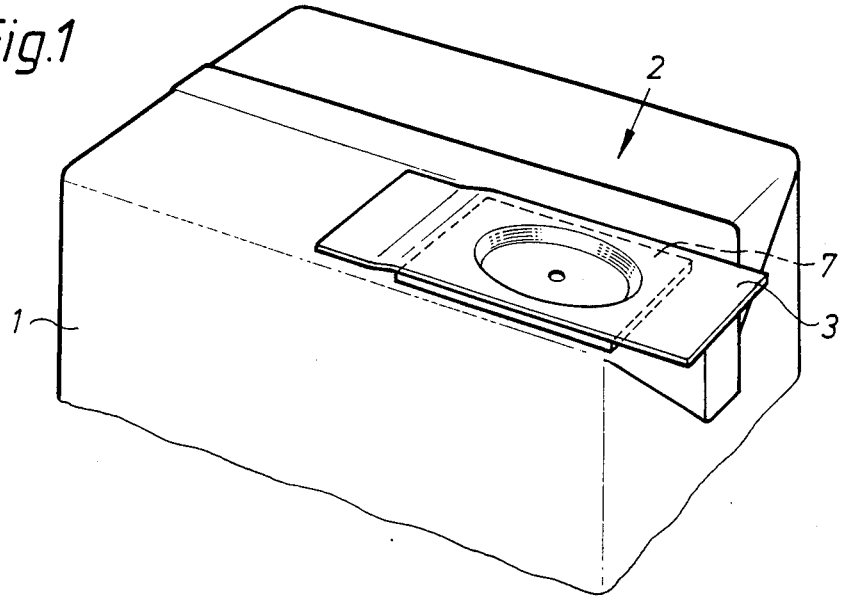
FIG. 1 is a perspective view of a top part of a packing container with an opening arrangement according to the invention applied to it.

FIG. 1 shows the top part of a packing container 1, of a known, substantially parallelepipedic, type. On the top side of the packing container 1 is located an opening arrangement 2 in the form of a pouring opening (not visible) and a gripping element 3 which consists of a flexible cover strip of thermoplastic layer material covering the pouring opening.

Figure 2:
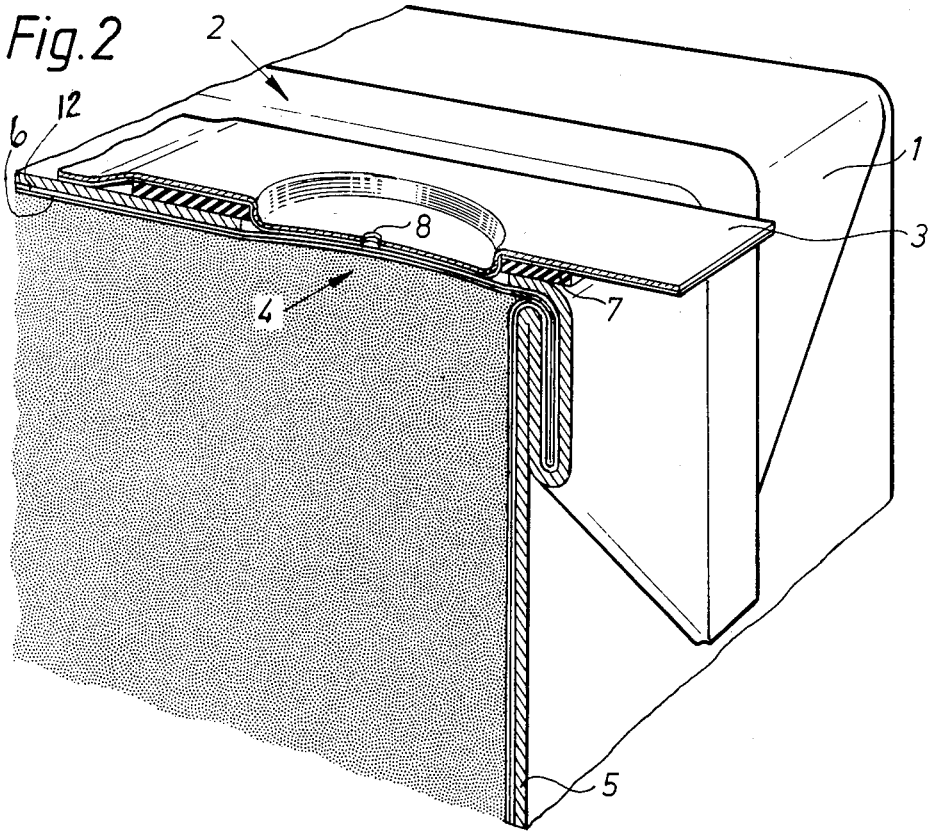
FIG. 2 is a perspective view taken partly in section and on a larger scale than FIG. 1 of the opening arrangement in accordance with FIG. 1.
Figure 3:
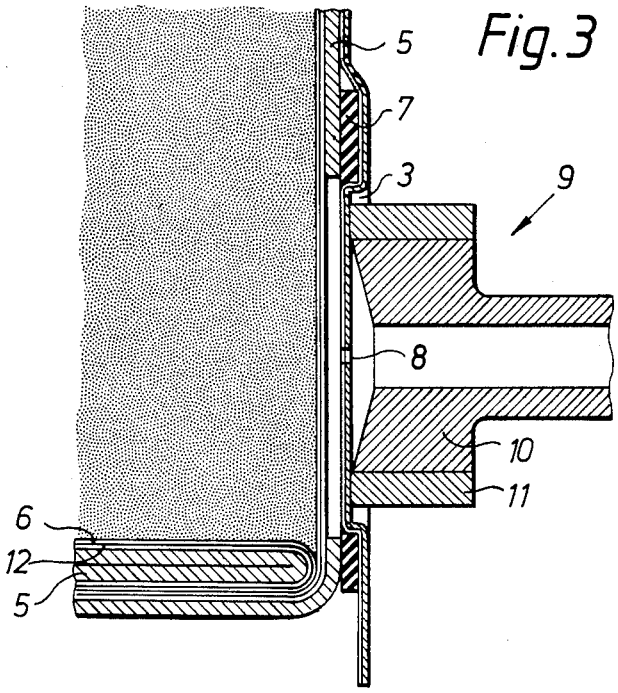
FIG. 3 is a sectional view of a part of a packing container and an application device during the application of a gripping element to the packing container in accordance with the method according to the invention.

In FIG. 2, the opening arrangement 2 is shown on a larger scale and partly in section. From the figure it is evident that the opening arrangement 2 is placed on the top side of the packing container 1 in such a manner that the strip-like gripping element 3 or the cover strip covers an openable area 4 present in the top side of the packing container. The openable area 4 comprises a pouring opening provided in the carrier layer 5 of the packing laminate, covered by a liquid-tight thermoplastic layer 6, which also covers the inside of the carrier layer 5 and ensures the liquid-tightness of the packing laminate and the packing container. The packing laminate may include, in addition to the carrier layer 5, e.g. of paper, and the layer 6 of thermoplastic material, also further external and/or internal layers of thermoplastics or aluminium foil 12 so as to ensure the desired gas and liquid leak-tightness. These layers, in such cases, are hot-sealed to one another within the openable area.

On the top side of the packing container is present preferably a material layer 7 of relatively rigid plastics, this material layer being of substantially rectangular shape (indicated by means of broken lines in FIG. 1) and a central hole whose shape and location correspond to the hole in the carrier layer 5 which delimits the openable area 4. The material layer 7 extends a little beyond the edge surface of the packing container and serves as a pouring edge during the emptying out of the contents via the pouring opening. On top of the material layer 7 (which possibly may be left out) is situated the gripping element or the cover strip 3. The cover strip 3 possibly is sealed to the material layer 7 around the openable area 4, but has in any case a projecting, unsealed end portion which serves as a gripping tab when the packing container is to be opened. In the central part of the gripping element or cover strip 3 covering the openable area 4 is present a gas-permeable area or suction opening 8, whose function will be described in greater detail in the following. The cover strip 3 with a recessed area extends down into the hole of the material layer 7, and is sealed there to the thermoplastic layer 6 of the packing laminate in a sealing zone extending along the edge of the openable area 4 or over the whole surface of the area 4.

When packing containers with opening arrangements according to the invention are to be finished, weblike packing laminate comprising the carrier layer 5 of paper, and at least one internal layer of liquid-tight thermoplastic material, is introduced to a packing machine (e.g. of the type which is described in the patent specification mentioned earlier). The packing material preferably also comprises further layers of thermoplastics and a layer of aluminium foil in order to ensure the high gas-tighteness required for aseptic packages. The packing laminate is provided, moreover, at equal intervals, with weakened, openable areas 4. The packing laminate is passed through a sterilizing arrangement, e.g. a bath of hydrogen peroxide, which after a certain time in contact with the packing material is removed again with the help of mechanical devices (mangle rollers) or hot air. During its continued travel through the packing machine the laminate is converted successively to a liquid-tight packing material tube, to which are continuously supplied liquid contents, eg. milk. The packing material tube is then transversely sealed at equal intervals by means of the application of heat and pressure, whereupon the tube is divided into individual packing container blanks through cuts in the transverse sealing zones. The packing container blanks, thus filled wholly or partly with contents, are subjected thereafter to a further form-processing for the purpose of giving them a substantially parallelepipedic shape through folding in of the corner lugs. The openable areas 4 present in the packing laminate, covered by the thermoplastic layer 6 and the aluminium foil, are located so on the packing material web that on the finished packing containers they are near to a corner on the upper end surface of the packing container.

When the individual, finished and filled packing containers leave the packing machine proper they are passed to an application arrangement according to the invention, wherein a gripping element in the form of a cover strip is applied over the weakened, openable area 4. In this process the packing container is placed lying on the side so that the openable area will be as low as possible for the purpose of increasing the pressure from the liquid contents present in the packing container, so that the part of the thermoplastic layer 6 and aluminium foil 12 which covers the openable area 4 is pressed slightly outwards. A gripping element 3 in the form of a flexible cover strip of thermoplastic material, together with the underlying material layer 7 provided with a hole is placed over the openable area 4, so that the gas-permeable opening 8 of the strip ends up substantially centrally over the openable area.

Figure 4:
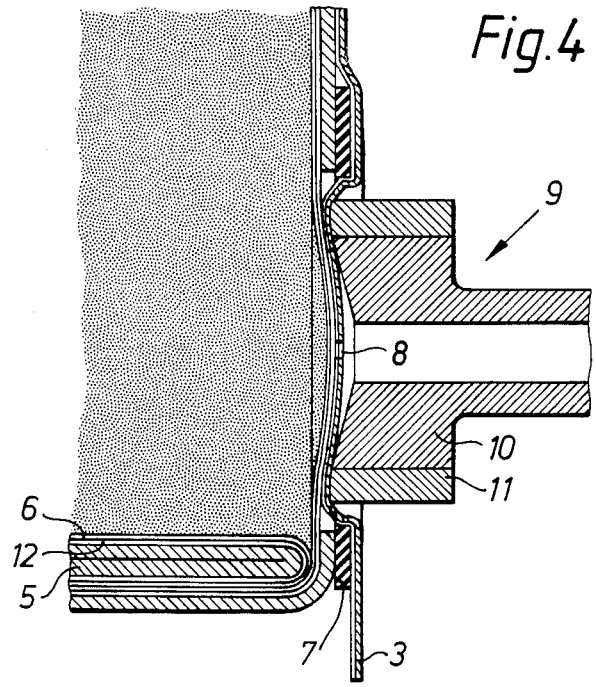
FIG. 4 is a sectional view of the application procedure in a slightly later phase than that shown in FIG. 3.

A sealing unit 9, which is reciprocally movable in the direction towards the place where the openable area 4 of the packing container is located, subsequently is pushed forwards so that its front end comes to rest against the part of the gripping element or cover strip 3, which is situated over (or possibly in) the opening area of the material 7 and the packing laminate. The sealing unit 9 is of a design adapted to the openable area 4 and comprises a centrally situated vacuum element 10 and a sealing device 11 surrounding it, which preferably is in the form of a coil for high-frequency sealing. As soon as the front end of the sealing unit 9 has come into contact with the cover strip 3 the vacuum element 10 is joined to a vacuum source of conventional type, so that air is evacuated from the front, cup-shaped end of the vacuum element 10. Air is evacuated thereby also via the suction opening 8 provided in the gripping element 3 from the space existing between the cover strip 3 and the packing material (thermoplastic layer 6 including aluminium foil layer 12) and delimited by the edge of the carrier layer 5, so that the parts of the thermoplastic layer 6 present in the openable area 4 and the cover strip 3 are brought into contact with each other (FIG. 4). At the same time the sealing unit 9 is moved a little further in the direction towards the packing container and the sealing device 11 is joined to a high-frequency source. At this, heat is induced in the aluminium foil 12 along an annular area which extends substantially along the contour line of the openable area 4. The heat is transferred directly to the adjoining thermoplastic layers so that, as they attain a temperature required for hot-sealing, they are sealed to one another within the annular area. After the sealing the current to the sealing device 11 is interrupted, the connection of the vacuum element 10 to the vacuum source is broken and the sealing unit performs a return stroke, so that its front end is removed from the packing container and the opening arrangement.

By means of the method, and with the help of the arrangement, in accordance with the invention, the packing container now has been provided with an external gripping element in the form of a cover strip which can be used for opening the weakened, openable area 4 of the packing container when the consumer wishes to consume the contents. The consumer then seizes the non-sealed end of the gripping element 3, mentioned earlier, and removes the gripping element which, owing to the seal between the gripping element and the thermoplastic layer 6 of the packing laminate, means that the part of the thermoplastic layer and the aluminium foil layer, which is located within the openable area, follows along so that the pouring opening is uncovered and may be used for emptying out the contents.

By means of the method and the arrangement in accordance with the invention it thus becomes possible to provide packing containers of this type with a readily accessible, externally placed gripping element, e.g. in the form of a cover strip, without the cover strip having to follow along through the packing machine and being exposed to the sterilizing agent. As a result, any risk of the sterilizing agent getting trapped between the cover strip and the packing laminate and accompanying the finished package is completely eliminated. The method has been found in practical trials to function well, and the opening arrangement as well as the arrangement for the application of the gripping element are so simple in their design that they can be manufactured and used at a low cost.

While this invention has been illustrated and described in accordance with a preferred embodiment, it is recognized that variations and changes may be made and equivalents employed herein without departing from the invention as set forth in the claims.

What is claimed is:

1. A method for forming an opening arrangement on a filled and closed packing container manufactured from a flexible packing material including a carrier layer and a liquid-tight thermoplastic layer which covers a surface of the carrier layer adapted to be an inside surface of the packing container, comprising the steps of:

converting the packing material into individual filled and closed packing containers each having an openable area defined therein by an opening provided in the carrier layer of the packing material which exposes the thermoplastic layer to the opening;

positioning a gripping element on the filled and closed packing container with the gripping element covering the openable area and defining an opening space between the gripping element and the thermoplastic layer exposed to the opening;

applying a vacuum pressure to the opening space to cause the thermoplastic layer and the gripping element to be pulled together; and heat-sealing the gripping element at the openable area to the thermoplastic layer exposed to the opening so that upon removal of the strip the thermoplastic layer will be removed from the opening along with the gripping element.

2. The method in accordance with claim 1, wherein the gripping element is sealed to the packing container material along an annular area of the openable area.

3. The method in accordance with claim 1, wherein the gripping element is heat-sealed to the packing material in an area surrounding the openable area.

4. The method according to claim 1, wherein the vacuum pressure applied to the opening space is applied through a gripping element opening provided in the gripping element and is applied until the gripping element and the thermoplastic layer are pressed together with a force suitable for the heat-sealing step.

* * * * *